United States Patent [19]

Baasch

[11] Patent Number: 4,506,656

[45] Date of Patent: Mar. 26, 1985

[54] METHOD AND APPARATUS FOR LIQUEFYING SNOW

[76] Inventor: Richard H. Baasch, Box 1, Hazard, Nebr. 68844

[21] Appl. No.: 563,177

[22] Filed: Dec. 19, 1983

Related U.S. Application Data

[63] Continuation-in-part of Ser. No. 396,070, Jul. 7, 1982, abandoned.

[51] Int. Cl.[3] ..... E01C 19/45; F24H 1/00

[52] U.S. Cl. ..... 126/343.5 R; 37/227

[58] Field of Search ..... 126/343.5 R, 343.5 A, 126/19.5; 37/227, 228, 230; 239/129, 130, 155, 156, 146; 432/13

[56] References Cited

U.S. PATENT DOCUMENTS

| | | | |
|---|---|---|---|
| 553,401 | 1/1896 | Von Garnier | 126/343.5 R |
| 557,163 | 3/1896 | Springfels | 126/343.5 R |
| 995,446 | 6/1911 | Evans | 126/343.5 R |
| 1,242,433 | 10/1917 | Friedman | 126/343.5 R |
| 1,451,027 | 4/1923 | Olsen | 126/343.5 R |
| 3,123,922 | 3/1964 | Spinelli | 126/343.5 R X |
| 3,140,707 | 7/1964 | Spinelli | 126/343.5 R |
| 3,577,975 | 5/1971 | Farsbetter | 126/343.5 R |

*Primary Examiner*—Randall L. Green

*Attorney, Agent, or Firm*—Harvey B. Jacobson

[57] ABSTRACT

A wheeled trailer main frame is provided including an upwardly opening tank supported therefrom for receiving a quantity of water therein from a below frost line pressurized supply of water. Motor driven agitator structure is disposed in the tank for mechanically agitating and rendering turbulent the water therein to thereby effect some heating of the water as a result of the turbulence thereof. Water is continuously admitted into the tank from the below frost line supply thereof and bulk quantities of snow intermittently may be dumped into the tank for melting therein as a result of the heat of the water supplied to the tank from the below frost line supply. An upper weir-type water outlet is provided and is operative to discharge water from the tank at a rate substantially equal to the rate of water supplied to the tank, plus the water volume added to the tank as represented by the intermittent dumping of bulk snow therein. Water for the tank may be provided from a water hydrant and the water discharged from the tank may be directed into a suitable street or storm drain.

5 Claims, 6 Drawing Figures

METHOD AND APPARATUS FOR LIQUEFYING SNOW

CROSS-REFERENCE TO RELATED APPLICATIONS

This application comprises a continuation-in-part of my co-pending U.S. application, Ser. No. 396,070, for Method and Apparatus for Melting Snow, filed July 7, 1982, now abandoned.

BACKGROUND OF THE INVENTION

The present invention relates to a wheeled vehicle which may be readily transported to a desired snow removal site and operatively associated with a storm drain as well as a supply of water such as a street hydrant. The wheeled vehicle may be self-propelled, but is preferably constructed in the form of a trailer to be towed behind a prime mover. In any event, the vehicle includes an engine mounted thereon for powering rotary snow break-up agitator structure which functions not only to break-up clumps of snow dumped into the tank but also to agitate and cause turbulence in the water within the tank into which the bulk snow to be melted is dumped.

Snow which is removed by various types of equipment may be transported to the vehicle and dumped into the upwardly opening tank and the water supplied to the tank from the hydrant is discharged into the tank through upper peripheral water outlet manifolds extending about major upper marginal portions of the tank. The water outlet manifolds are constructed to include water jet outlet structure and the jets of water to be discharged from the water outlet manifolds are inwardly and downwardly directed along the upper wall portions on the tank. The water jets serve to prevent snow from clinging to the sides of the tank and to wet the snow before it falls downwardly into the water supplied to the tank. The water within the tank is mechanically agitated in order to more quickly melt the bulk snow dumped therein and the means by which the water is mechanically agitated is driven by a combustion engine including an exhaust gas system incorporating a heat enchanger whereby a considerable portion of the heat of the exhaust gases from the combustion engine may be transfered by the water within the tank. Water is discharged from the tank through the utilization of a weir-type outlet and therefore at a rate which is substantially equal to the rate of input of water to the tank from an underground source, plus the quantity of water represented by the bulk snow melted in the tank. Therefore, the snow melting process is a continuous operation and although the bulk snow to be melted is intermittently dumped into the tank, a large snow melting operation could utilize a snow feeding system for the tank which is operable to supply bulk snow to the tank at a substantially constant rate.

By utilizing the heat of relatively inexpensive water supplied to the tank through a domestic underground water system considerable quantities of snow may be removed by conventional snow removal equipment and disposed of (melted) without trucking or otherwise transporting the the removed snow over great distances.

Various forms of snow removal and disposal structure including some of the general structural and operational features of the instant invention are disclosed in U.S. Pat. Nos. 2,991,784, 3,171,405, 3,277,885, 3,803,732, 3,886,340 and 4,288,931.

However, these previously known devices have not been specifically designed to provide a relatively inexpensive snow disposal apparatus which may be readily transported to a snow removal site and used to dispose of considerable quantities of snow at a relatively low cost. Further, although U.S. Pat. Nos. 3,866,340, 3,803,732, 3,277,885 and 3,171,405 disclose tanks into which bulk snow may be received and which contains a slurry of water and snow to which heat energy is supplied for melting additional snow added to the slurry, these prior patented devices all utilize some form of fuel for inputting substantially all of the heat energy to the slurry which is necessary to melt the bulk snow to be added to the slurry, and it has been found that water from an underground domestic water supply is maintained at approximately 52°–55° by the temperature of the ground below frost level and that the heat content of the water represented by the heat value thereof above zero° C. constitutes a considerable amount of heat available for melting the bulk snow intermittently dumped into the tank.

BRIEF DESCRIPTION OF THE INVENTION

The instant invention incorporates a mobile chassis which may be towed to a snow removal site adjacent a supply of below frost level water under pressure such as a water hydrant. The mobile chassis includes a combustion engine supported therefrom and drivingly connected to agitator structure disposed within a large upwardly opening tank supported from the mobile chassis and water from the hydrant may be supplied to the tank at a substantial and constant rate. The tank includes a weir-type water outlet for discharging water from the tank to a storm or street drain and bulk quantities of snow may be intermittently dumped into the tank for melting therein. Accordingly, the rate of discharge of water from the tank is equal to the rate of input of water to the tank from the associated hydrant, plus the quantity of water represented by the bulk snow intermittently dumped into the tank.

The main object of this invention is to provide an apparatus which may be utilized to dispose of large quantities of snow which has been removed through the utilization of attendant snow removal equipment.

Another object of this invention is to provide an apparatus for disposal of snow which may be readily transported to a snow removal site.

Still another object of this invention is to provide a snow removal apparatus in accordance with the preceding objects and which may perform its snow disposal function in almost automatic operation at a minimum of cost.

Yet another object of this invention is to provide a snow disposal apparatus which may be used in residential, city and industrial areas with equal efficiency.

Another important object of this invention is to provide a snow removal apparatus which will not utilize large amounts of expensive heat energy as is usually the case with snow disposal equipment.

A final object of this invention to be specifically enumerated herein is to provide a method and apparatus for snow disposal in accordance with the preceding objects and which will conform to conventional forms of manufacture, be of simple constructure and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
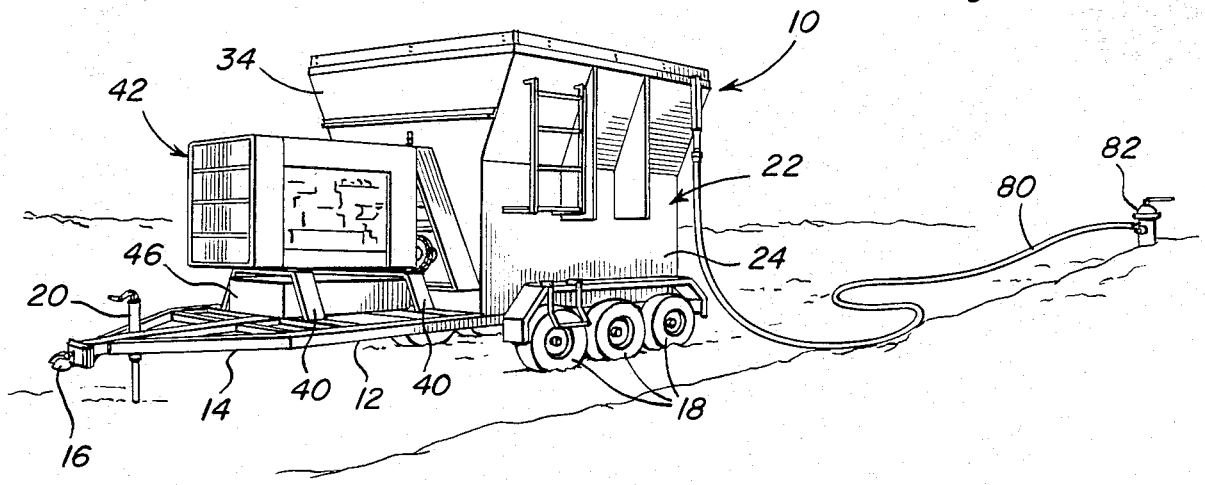
FIG. 1 is a perspective view of the snow melting and disposal apparatus of the instant invention constructued in trailer form and with the trailer operatively associated with a fire hydrant for receiving water therefrom and positioned adjacent a storm or street drain for discharge of water from the trailer into the drain.
Figure 4:
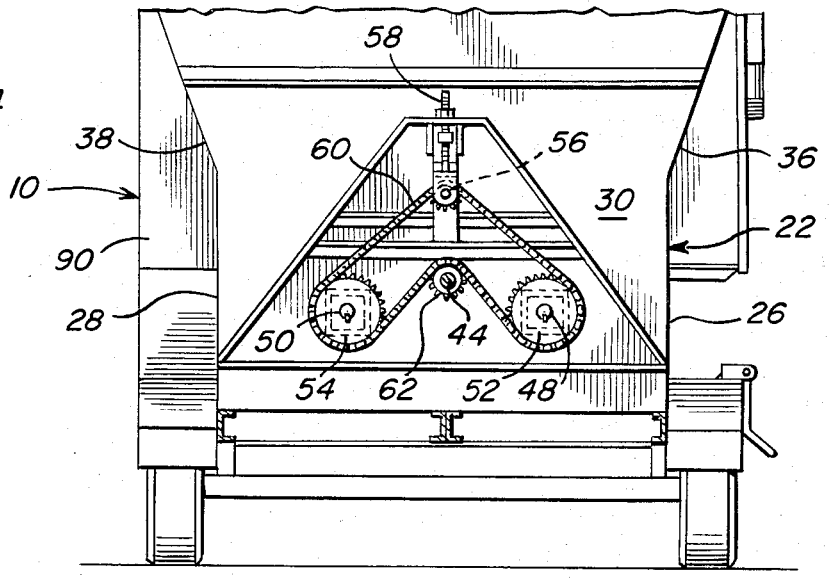
FIG. 4 is a fragmentary transverse vertical sectional view taken substantially upon the plane indicated by the section line 4—4 of FIG. 3.
Figure 5:
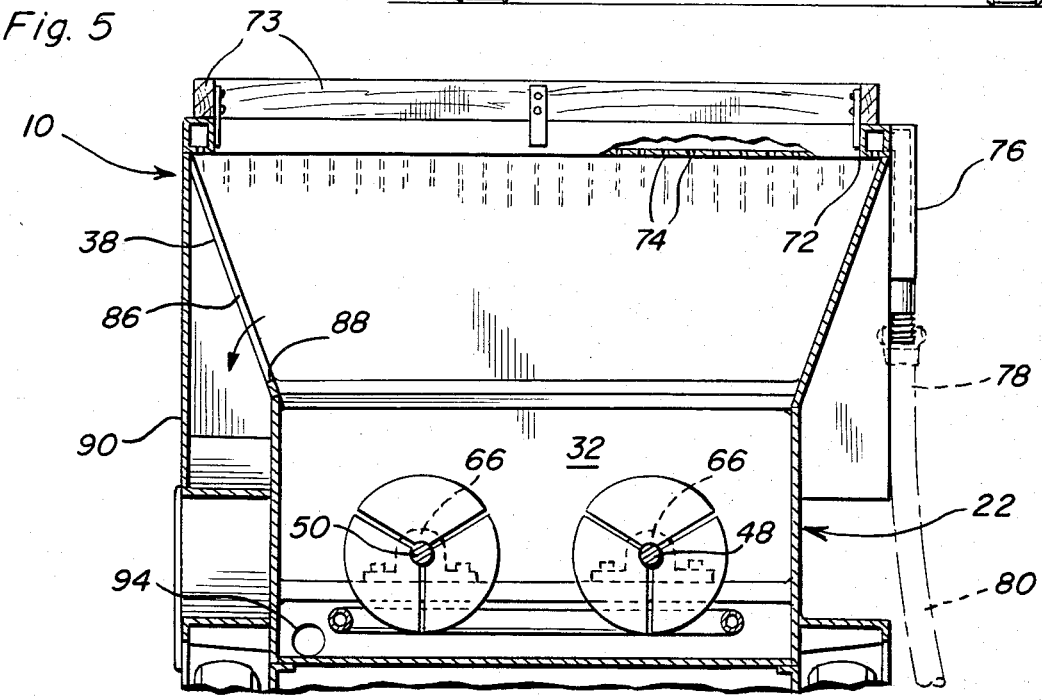
FIG. 5 is a fragmentary transverse vertical sectional view taken substantially upon the plane indicated by the section line 5—5 of FIG. 2.
Figure 2:
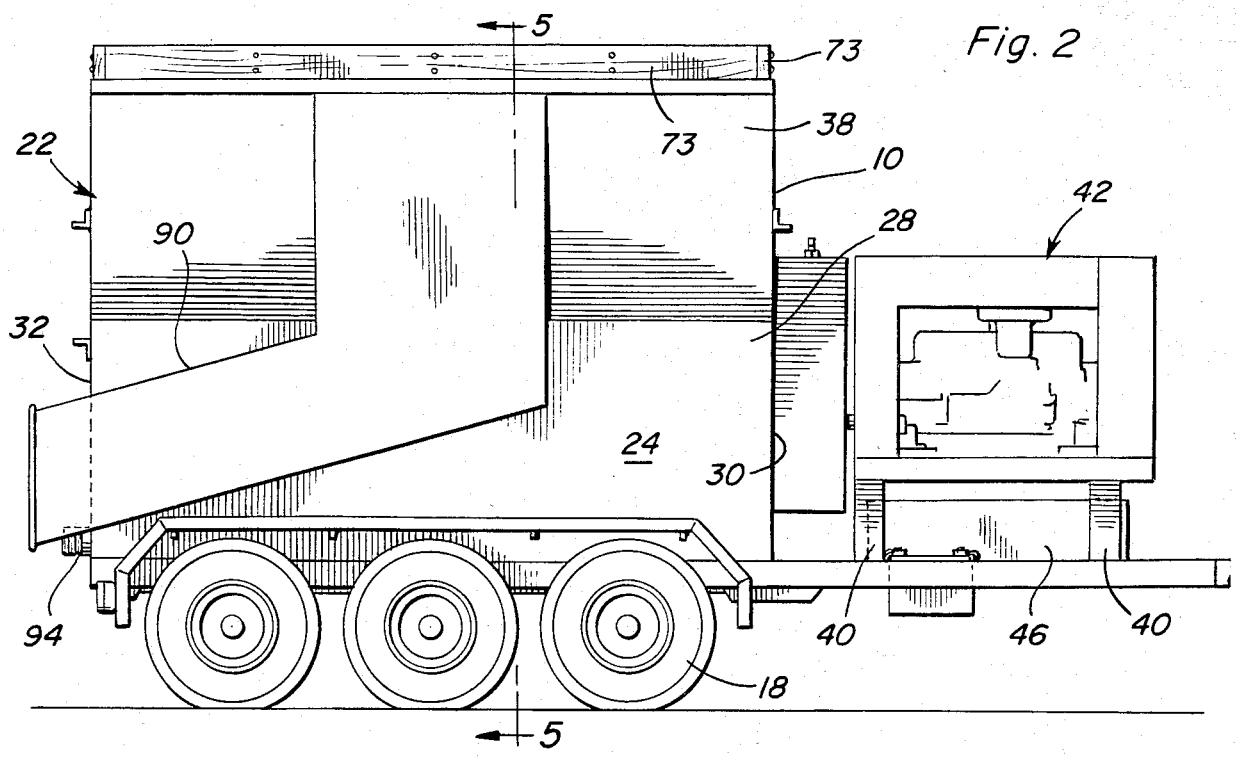
FIG. 2 is a enlarged side elevational view of the trailer as seen from the right side thereof.

Referring now more specifically to the drawings, the numeral 10 generally designates the snow melting and disposal apparatus of the instant invention. The apparatus 10 includes a main frame 12 in the form of a trailer frame equipped with a forwardly projecting towing tongue 14 provided with a tow hitch couple 16 on the forward end thereof. The main frame 12 includes triple axle assemblies 18 and the towing tongue additionally includes a downwardly extendible and upwardly retractable screw jack stand 20.

Mounted on the frame 12 is a body referred to in general by the reference numeral 22 and defining an upwardly opening tank. The tank 22 includes a lower portion 24 including substantially vertical upstanding opposite sidewalls 26 and 28 and substantially vertical front and rear walls 30 and 32. Further, the tank includes an upper portion 34 having upwardly divergent opposite sidewalls 36 and 38, the front and rear walls 30 and 32 also closing the front and rear portions of the upper portion 34.

A pair of prime mover mounts 40 are supported from a rear portion of the towing tongue 14 and a prime mover referred to in general by the reference numeral 42 is supported from the mount 40. The prime mover 42 may be in the form of an industrial internal combustion engine and includes a rotary drive output shaft comprising the output shaft 44 of a gear reduction unit. Further, a fuel tank 26 for containing fuel for the prime mover 42 is supported from the tongue 14 beneath the elevated central portions of the prime mover mounts 40.

A pair of opposite side front-to-rear extending shafts 48 and 50 extending longitudinally of the tank 22 and are journalled from the front and rear walls 30 and 32. The front ends of the shafts 48 and 50 project through the front wall 30 and have sprocket wheels 52 and 54 mounted thereon. In addition, an idler sprocket 56 is journalled from the tank 22 forward of the front wall 30 thereof and is mounted for vertical adjustment relative to the tank 22 by an adjustment screw 58. An endless chain 60 is trained about sprocket wheels 52, 54 and 56 as well as a sprocket wheel 62 mounted on the shaft 44. Accordingly, the prime mover 42 is drivingly coupled to the shafts 48 and 50.

The longitudinal midportion of the interior of the tank 22 includes a transverse brace 64 from which pillow blocks 66 are supported which journal the longitudinal midportions of the shafts 48 and 50 and the shafts 48 and 50 include bladed screw-type propellers 68 and 70 mounted thereon. The propellers 68 and 70 are alternately spaced along the shafts 48 and 50 and are operative, upon rotation of the shafts 48 and 50 to direct currents of water in which the shafts 48 and 50 are disposed in opposite directions along the shafts.

The upper marginal edges of the tank 22 are provided with conventional bang boards 73 and the upper marginal edges of the walls of the tank 22 include integral water outlet manifolds 72 provided with longitudinally spaced downwardly opening water outlet openings 74 spaced therealong. The manifolds 72 are interconnected and the apparatus 10 includes a water inlet fixture 76 opening into one of the manifolds 72 and to which the discharge end 74 of a large water flow capacity hose 80 may be removably connected. The hose 80 may extend and be operably connected to the water outlet of a fire hydrant or other source of below frost level underground water.

The sidewall 38 includes a midlength weir-type water outlet opening 86 therein extending down to a minimum desired water level 88 disposed appreciably above the shafts 48 and 50 and the water outlet opening 86 constitutes the water inlet for a downwardly directed and rearwardly and downwardly opening water outlet duct 90 supported from the right side of the body 22. The lower rear discharge end of the duct 90 may be communicated with a suitable street or storm drain either by gravity and location or through the utilization of a closed water conduit connected at one end to the duct 90 and at the other end to the associated storm drain. However, it is also possible that the apparatus 10 may discharge water from the tank or body 22 directly upon the ground, depending upon the terrain and locale of the use of the apparatus 10.

The lower portion of the tank or body 22 defines a sump equipped with a drain 94 which may be maintained closed during use of the apparatus 10 but opened to drain contaminants such as dirt and the like from the lower sump portion of the tank 22, when such drainage is required.

In operation, the apparatus 10 is operatively associated with the hydrant 82 and water is allowed to flow from the hydrant 82 through the manifolds 72 and into the tank 22 at a predetermined rate until the water level within the tank 10 is disposed above the upper portions of the propellers 68 and 70 and below the point 88. Thereafter, the prime mover 42 may be actuated to cause rotation of the shafts 48 and 50 to generate considerable turbulence of the water within the tank 22. Then, with the water outlet duct 90 operatively associated with an area for receiving water such as a storm drain or a depressed area of terrain, bulk snow may be trucked to the apparatus 10, dumped and thereafter loaded into the body 22 through the open top thereof through the utilization of equipment such as front loaders.

Inasmuch as the water supplied to the tank 22 from the hydrant 82 is approximately 50°–55° F. a considerable amount of heat energy is represented by the water within the tank 22. If water is supplied to the tank at a relatively slow rate such as 100 gal. per minute, the apparatus 10 will be operative to melt approximately 45 cubic yards of snow per hour. If, on the other hand, water is supplied to the tank at the rate of 1000 gal. per minute, the apparatus 10 will be operative to melt approximately 450 cubic yards of snow per hour. Therefore, it may be seen that for every 100 gal. per minute inflow of water to the tank 22, approximately 45 cubic yards of snow per hour may be melted and thus economically disposed of.

Figure 3:
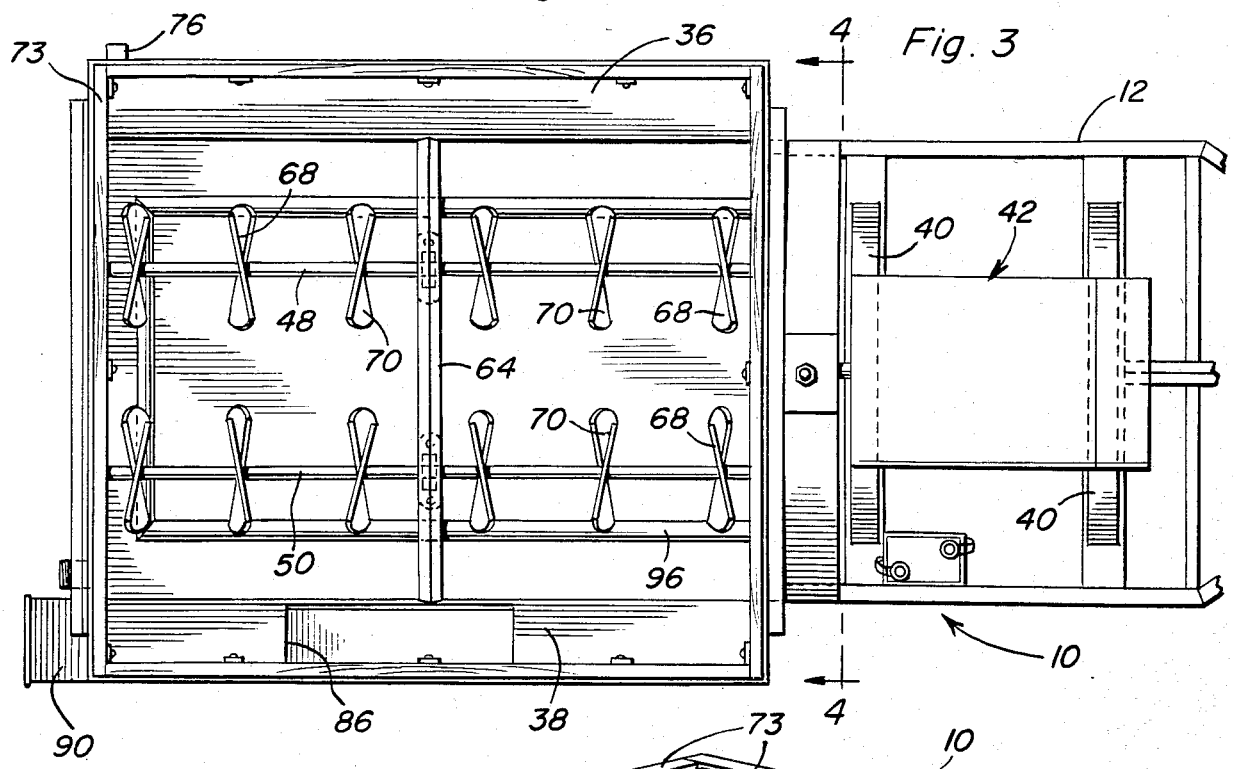
FIG. 3 is a fragmentary top plan view of the trailer.
Figure 6:
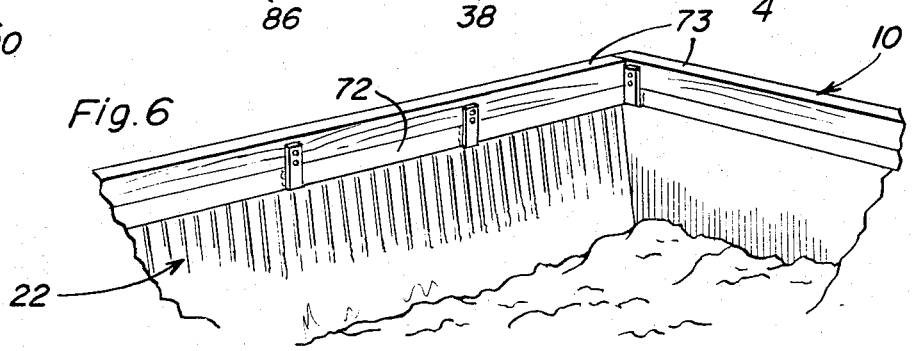
FIG. 6 is a fragmentary perspective view of one upper corner portion of the tank of the snow melting and disposal apparatus.

The prime mover 42 includes an engine exhaust pipe 96 (see FIG. 3) which passes through a lower portion of the interior of the tank 22 and thus adds a small amount of additional heat input to the water within the tank 22.

The propellers 68 and 70 serve not only to impart considerable turbulence to the water within the tank 22 but also to impart an additional small amount of heat energy to the water.

It is pointed out that the flow of water into the tank 22 from the hydrant 82 will be controlled such that the discharge of water from the tank 22 through the duct 90 will be but a few degrees above the temperature at which water freezes. Accordingly, substantially all of the useful BTU value of the water supplied to the tank 22 will be used to melt snow before that water and the additional water represented by the melted snow will be discharged from the tank through the duct 90. Further, although each batch of bulk snow dumped into the tank 22 by a front loader may represent a considerable quantity of bulk snow, there will necessarily be time intervals between each period of dumping of bulk snow into the tank 22 during which the amount of bulk snow previously dumped into the tank will be melted therewithin.

By discharging water from the tank 22 through the weir-type opening 88, small lumps of slush which offer no obstruction to an associated storm or sewer drain may be discharged from the tank 22 before being completely melted. Therefore, the use of a wier-type discharge opening reduces, to some extent, the total heat value of the input water required to dispose of a given quantity of bulk snow.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A snow melting apparatus including an upwardly opening tank, agitator means disposed in a lower portion of said tank, water inlet means for admitting water into the interior of said tank at a predetermined rate, water outlet means for discharging water from said tank at a level spaced above said lower portion, motor means disposed exteriorly of said tank for driving said agitator means, said agitator means including a plurality of parallel shafts journalled from said lower portion of said tank, said shafts including bladed propeller means thereon, said motor means being drivingly connected to said shafts, said propeller means including a plurality of bladed propellers spaced longitudinally on each of said shafts, the blades of at least two of the propeller means on said shafts being of opposite pitch and said shafts each being driven in a direction in which the two propeller means thereon pump water in said tank toward each other.

2. The snow melting apparatus of claim 1 wherein said water inlet means includes upper water inlet manifold means extending about upper marginal edge portions of said tank and including a plurality of water outlets for directing jets of water therefrom downwardly into said tank, said water outlet means including a weir-type water outlet disposed at an elevation spaced appreciably above said agitator means and below the upper marginal edges of said tank.

3. The snow melting apparatus of claim 2 wherein said tank is supported from a wheeled main frame for ready transport of said tank from one location to another.

4. The snow melting apparatus of claim 3 wherein said wheeled main frame comprises a trailer frame equipped with a forwardly projecting towing tongue including structure at the forward end thereof for coupling to a prime mover.

5. The snow melting apparatus of claim 1 wherein said motor means comprises an internal combustion engine and said engine includes an exhaust gas pipe including an intermediate length portion thereof passing through the lower portion of said tank.

* * * * *